United States Patent [19]

Streichenberger

[11] Patent Number: 4,623,433

[45] Date of Patent: Nov. 18, 1986

[54] PROCESS FOR ORIENTING AND ACCELERATING THE FORMATION OF CONCRETIONS IN A MARINE ENVIRONMENT

[75] Inventor: Antonius O. Streichenberger, Nantes, France

[73] Assignee: Societe Responsabilite Limitee REP MARINE les Rochereaux, Le Cellier, France

[21] Appl. No.: 697,763

[22] Filed: Feb. 4, 1985

[30] Foreign Application Priority Data

Feb. 3, 1984 [FR] France ..... 84 01697

[51] Int. Cl.[4] ..... C25B 1/00; C25D 9/08

[52] U.S. Cl. ..... 204/1 R; 204/23; 204/56 R

[58] Field of Search ..... 204/1 R, 16, 23, 56 R

[56] References Cited

U.S. PATENT DOCUMENTS

| | | | |
|---|---|---|---|
| 4,246,075 | 1/1981 | Hilbertz | 204/1 R |
| 4,507,177 | 3/1985 | Duckworth | 204/1 R |
| 4,537,078 | 9/1985 | Wingfield | 204/1 R |

FOREIGN PATENT DOCUMENTS

| | | | |
|---|---|---|---|
| 1321837 | 2/1963 | France | 204/1 R |
| 540487 | 10/1941 | United Kingdom | 204/1 R |

*Primary Examiner*—T. M. Tufariello

*Attorney, Agent, or Firm*—Young & Thompson

[57] ABSTRACT

The present invention concerns a process for orienting and accelerating the formation of concretions in marine environment, wherein a metallic cathode having a shape corresponding to the skeleton of the concretion to be formed and an anode made of a metal or a metal alloy which is more electronegative than the metal or the alloy of the cathode are used, by immersing the anode and the cathode in an amphoteric electrolyte containing magnesium, calcium and carbonate ions, such as sea water, and by electrically interconnecting the two electrodes, and an apparatus for practicing the same. The process is characterized in that the ratio of the surface of the anode to the surface of the cathode is between 1/30 and 2/1, with the anode mass sufficient to maintain this ratio within said limits during a period of time comprised between a few days and one year. Application to the formation of artificial reefs, the consolidation of marine soils, or stopping cracks in submerged constructions, etc.

11 Claims, No Drawings

PROCESS FOR ORIENTING AND ACCELERATING THE FORMATION OF CONCRETIONS IN A MARINE ENVIRONMENT

The present invention concerns the formation of calcareous concretions in a marine environment and, more generally, in an amphoteric electrolyte such as sea water containing at least magnesium, calcium and carbonate ions.

In U.S. Pat. No. 4,246,075. it is proposed to form such concretions by connecting a source of direct electric current between a cathode constituting the core of the concretion and one of several anodes positioned in proximity to the cathode. This process ensures the formation of a mineral deposit on the cathode.

However, this process requires a direct current source connected to the electrodes. It is obvious that the requirement for a direct current source constitutes an important limitation for practicing the process.

On the other hand, processes called cathode protection processes by sacrificial anodes are known, in which, to protect a surface made of metal, generally a ferrous metal, against corrosion by sea water, an anodic electrode made of a metal or a metallic alloy having a spontaneous potential which is more electronegative than the metal to be protected and made, for example, of aluminum, zinc or magnesium alloys is immersed in the sea water or connected with sea water which is in contact with the surface to be protected, at a short distance from the latter. The ratio of the surface of the anodic electrode to the surface to be protected is about 1/50 to 1/500 and the cathodic current densities are of the order of $10^{-3}$A/m$^2$ to 0.5 A/m$^2$, so that the life of the anodes is long, the protection being assured during said long life.

A detailed study of the cathodic protection mechanism in a marine environment has led to the explanation that a thin layer, made basically of aragonite or calcium carbonate which is finely crystalline just as the other included minerals, is formed on the surface of the cathode, said layer increasing the electric resistance between the cathode and the sea water. When this thin layer is mechanically destroyed, it is formed again under the influence of the electrolytic couple existing between the anode and the cathode. The phenomenon applied to cathodic protection seemed to hinder the formation of concretionary layers of substantial thickness, due in particular to the formation of a finely crystalline layer of low permeability.

A study of the structures of the layers and a comparative study of the phenomenon of concretion in a marine environment, such as described in U.S. Pat. No. 4,246,075 and the phenomenon of cathodic protection, have led to the observation that, according to the pH-value, a deposit of brucite (magnesium hydroxide) occurred at a pH near to and greater than 9.5, whereas for a lower pH, a deposit of aragonite (calcium carbonate) can occur. Moreover, experience has shown that with a high cathodic current density causing a rapid deposit, brucite is formed in the form of large crystals having a porous structure and a low electrical resistance, whereas a low cathodic current density produces a deposit of small crystals having an impermeable structure and a high electrical resistance. Moreover, in the absence of a galvanic couple, the brucite with a coarse crystallization is dissolved in sea water by maintaining inside its mass a high pH corresponding to a pH of active deposit of the aragonite. After removing the anodic potential, the deposit comprised predominantly of brucite is transformed into a concretion predominantly of aragonite, under certain conditions.

The present invention has as its object the formation, by the process of electrolytic deposition by sacrificial anodes, used for cathodic protection, of a substantial layer of a deposit comprised predomiantly of brucite having large crystals producing a porous mass having a high water content and capable of being subsequently transformed into a concretion comprised predominantly of aragonite.

According to the invention, this object is achieved by using a metallic cathode whose shape corresponds to that of the concretion to be formed, and an anode of a metal or metal alloy which is more electronegative than the metal or the alloy of the cathode, by immersing the anode and the cathode in an amphoteric electrolyte containing magnesium, calcium and carbonate ions, such as sea water, and by electrically interconnecting the two electrodes, the process according to the invention being characterized in that the ratio of the surface of the anode to the surface of the cathode is comprised between 1/30 and 2/1, with a mass of the anode which is sufficient to keep this ratio inside said limits during a period of time comprised between a few days and one year.

With the above-mentioned ratio between the anodic and cathodic surfaces, the density of the cathodic current is greater than 0.5 A/m$^2$ and generally greater than 1 A/m$^2$, and the pH at the cathode is higher than 9.5, which produces a deposit comprised predominantly of brucite. The period of time during which the anode which gradually loses weight and surface, continues to have a surface ratio which is greater than 1/30, depends on the resistivity and therefore partly on the salinity of the electrolyte which can be sea water, brackish water or water which is artificially made saline.

According to the conditions of the deposit and in particular the speed, the brucite is dissolved more or less rapidly when the pH is lowered as a consequence of the reduction of the cathodic current density. With a rapidly deposited deposit comprised predominantly of brucite, the dissolution speed of the brucite is in danger of being so high that the slow growth of aragonite crystals does not allow ensuring the filling of the spaces left by dissolution.

To overcome this and accodrding to another characteristic of the invention, after the formation of the layer of the deposit comprised predominantly of brucite and having a desired thickness, a cathodic current densityis maintained ensuring a pH which is lower than the pH of the dissolution of the brucite, but is higher than the pH of the sea water by means of a sacrificial anode having a surface ratio which is lower than 2/1 and capable of being even lower than 1/30 according to the nature of the anode.

By way of example, the spontaneous potential of steel in sea water with a temperature that can change between 5° and 20° C., with a pH close to 8.20 and a 35% salinity, is comprised between −800 and −1350 mV with respect to a saturated calomel reference electrode (ECS) according to the cathodic current density used. It is possible to use as the metal of the anode either an aluminum alloy having an electronegative potential close to −1100 mV (ECS), a zinc alloy having an electronegative potential close to −1050 mV (ECS) or a magnesium alloy having an electronegative potential close to −1500 mV (ECS).

According to another characteristic of the invention, the cathode and the anode are in direct electrical contact, the elements constituting the anode such as bars or wire being capable of being inserted in a system of similar elements constituting the cathode with contacts distributed within the network.

The conditions imposed by the process require that, in order to produce the necessary cathodic current density, it is necessary to use cathode members whose section is above a minimum. As a consequence, in the system, the cathode members have a substantial spacing. It is often desirable to increase the volume of the deposit comprised predominantly of brucite or its mechanical resistance, which cannot ensure the cathode members having a great spacing and, according to the invention, this result is obtained by incorporating into the system constituting the apparatus, insert fillers such as sand, natural or synthetic fibers, etc. It is also within the scope of the process to sink at least the cathode into a porous mass of inert elements such as sand or fibers, this mass being impregnated by the electrolyte, namely sea water or the like.

Apparatus for practicing the method of the present invention can comprise a structure made of a ferrous metal corresponding to the skeleton of the concretion to be formed, elements made of a metal or an alloy and having a spontaneous potential which is more electronegative than iron having an electrical connection between said structure and said elements, the ratio of the surface of said elements to the surface of the structure being between 1/30 and 2/1.

The elements can be in the form of wires, bars, blades or small bars having different cross sections or in the form of small plates. The electrical connection can be assured by an intermediate conductor which is electrically joined to the structure made of ferrous metal or to the element or elements. It can also be direct, the elements being directly joined to the ferrous metal structure by welding, mechanical gripping or the like, so as to assure said electrical connection.

When the element is in the form of a blade, a small plate or in another form having an almost constant thickness, it preferably has an increased thickness constituting a core whose peripheral surface is smaller than 1/30th of the superficial surface of the structure, the electrical connection being assured on said core. According to another characteristic, several types of elements are provided for having variable thicknesses perpendicular to their superficial surfaces, the total of the superficial surfaces of the thickest elements being less than about one thirtieth of the superficial surface of the structure. These last two characteristics have as their object, after consumption of the thin part of the element assuring the deposit comprised predominantly of brucite, to let subsist an electronegative anodic element which restrains the dissolution of the brucite and favors the concretion of the brucite mass by the aragonite.

According to another charactristic of the invention, the ferrous metal structure is mechanically joined with electrically inert materials which are present in a porous state, such as sand enclosed within a porous casing, natural or synthetic fibers, tubes or pierced sheaths, etc.

As the ferrous metal structure has to have a weak electric resistance, therefore a considerable cross section, which cross section is also necessary to allow the sinking in sand beds, but a reduced surface connected to the electrolyte in order to have a high cathodic current density, it is possible to encase the structure with an insulator while keeping bar regions in the form of rings, strips or crosspieces for the anchoring of the deposit comprised predominantly of brucite. The anodic element can be in the form of bare regions outside the sheath with a direct electrical contact through the insulator.

The process has numerous uses.

A first use is the accelerated construction of artificial submarine reefs, the skeleton of the reef being comprised by a ferrous metal, for example, wire or iron bars with small plates or bars made of magnesium and/or aluminum which are fixed by being distributed in the structure.

A second application is the stabilization of marine soils such as sandy soils to be provided with buildings, this stabilization being able to be accomplished either by sinking in the porous sandy mass, according to a network of electrodes constituting cathodes and anodes with electrical interconnections, or of linear elements comprising both cathodic surfaces and anodic elements, or by the formation of a superficial concretion by spreading out over the soil a welded network or latticework of ferrous metal with associated anodic elements.

A third application of great economic interest is the stopping of cracks and warping of joints in marine constructions, such as immersed or submerged dams, various basins, etc., by inserting an element having the shape of a strip, a coil or the like comprising ferrous metal elements and elements made of aluminum, zinc or alloys thereof in cracks or joints.

It is also possible to build or strengthen the immersed or submerged parts of marine constructions such as cofferdams, pontoons, etc. by guided concretion.

The above-mentioned applications are given only as illustrative examples.

I claim:

1. Process for orienting and accelerating the formation of concretions in a marine environment, wherein a metallic cathode having a shape corresponding to the skeleton of the concretion to be obtained and an anode made of a metal or a metallic alloy which is more electronegative than the metal or the alloy of the cathode are used by immersing the anode and the cathode in an amphoteric electrolyte containing magnesium, calcium and carbonate ions, and by electrically interconnecting the two electrodes, characterized in that the ratio of the surface of the anode to the surface of the cathode is between 1/30 and 2/1, with the anode mass sufficient to keep this ratio within said limits during a period of time comprised between a few days and one year.

2. Process according to claim 1, characterized in that, after the formation of the layer of the deposit comprised predominantly of brucite and having a desired thickness, a cathodic current density is maintained ensuring a pH which is lower than the pH of dissolution of the brucite, but which is higher than the pH of the sea water, by means of a sacrificial anode having a surface ratio which is lower than 2/1.

3. A process according to claim 2, in which said surface ratio is lower than 1/30.

4. Process according to claim 1, characterized in that aluminum, zinc, magnesium or alloys thereof are used as the metal for the anode.

5. Process according to claim 1, characterized in that the cathode and the anode are in direct electrical contact, the elements constituting the anode being adapted to be inserted in a network of similar elements constituting the cathode with contacts distributed within the network.

6. A process according to claim 5, in which said anode is wires or bars.

7. Process according to claim 1, characterized in that inert fillers are incorporated in the network constituting the apparatus.

8. A process according to claim 7, in which said inert fillers are sand, natural or synthetic fibers.

9. Process according to claim 1, characterized in that at least the cathode is sunk in a porous mass of inert elements, this mass being impregnated by the electrolyte.

10. A process according to claim 9, in which said inert elements are sand or fibers.

11. A process according to claim 1, in which said electrolyte is sea water.

* * * * *